US011094250B2

(12) United States Patent
Mou et al.

(10) Patent No.: US 11,094,250 B2
(45) Date of Patent: Aug. 17, 2021

(54) METHOD AND APPARATUS FOR AN ELECTROLUMINESCENT DEVICE

(71) Applicants: Chengdu BOE Optoelectronics Technology Co., Ltd., Chengdu (CN); BOE Technology Group Co., Ltd., Beijing (CN)

(72) Inventors: Xin Mou, Beijing (CN); Yuhsiung Feng, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/640,053

(22) PCT Filed: Aug. 26, 2019

(86) PCT No.: PCT/CN2019/102593

§ 371 (c)(1),
(2) Date: Feb. 18, 2020

(87) PCT Pub. No.: WO2020/140464

PCT Pub. Date: Jul. 9, 2020

(65) Prior Publication Data

US 2021/0142720 A1 May 13, 2021

(30) Foreign Application Priority Data

Jan. 4, 2019 (CN) ..... 201910008053.0

(51) Int. Cl.
*G09G 3/3208* (2016.01)

(52) U.S. Cl.
CPC ..... *G09G 3/3208* (2013.01); *G09G 2310/06* (2013.01); *G09G 2320/041* (2013.01)

(58) Field of Classification Search
CPC ..... G09G 3/3208; G09G 2310/06; G09G 2320/041
See application file for complete search history.

(56) References Cited

U.S. PATENT DOCUMENTS 6,531,716 B2 * 3/2003 Udagawa ..... H01L 21/02381 257/102
2004/0041751 A1 3/2004 Takahashi
(Continued)

FOREIGN PATENT DOCUMENTS

CN 1893744 A 1/2007
CN 104732921 6/2015
(Continued)

OTHER PUBLICATIONS

PCTCN2019102593_ISR.
201910008053_OA1.
201910008053_OA1_EN.

*Primary Examiner* — Stacy Khoo
(74) *Attorney, Agent, or Firm* — IPro, PLLC

(57) ABSTRACT

Disclosed herein is a method comprising: determining a first waveform of electric voltage based on a history of operation of an electroluminescent device, the history of operation comprising one or more parameters selected from the group consisting of durations of light emission of the electroluminescent device, intensities of light emission of the electroluminescent device, temperatures of the electroluminescent device during light emission, and combinations thereof; applying the first waveform of electric voltage to the electroluminescent device.

21 Claims, 10 Drawing Sheets

(56) References Cited

U.S. PATENT DOCUMENTS

| | | | | |
|---|---|---|---|---|
| 2016/0171931 | A1* | 6/2016 | Liu | G09G 3/3208 345/694 |
| 2020/0118487 | A1* | 4/2020 | Kim | G09G 3/3225 |

FOREIGN PATENT DOCUMENTS

| | | | | |
|---|---|---|---|---|
| CN | 105575335 | A | | 5/2016 |
| CN | 105792430 | A | | 7/2016 |
| CN | 108932925 | A | | 12/2018 |
| CN | 109116108 | A | * | 1/2019 |
| CN | 109410843 | A | | 3/2019 |
| JP | 2005148388 | A | | 6/2005 |

* cited by examiner

METHOD AND APPARATUS FOR AN ELECTROLUMINESCENT DEVICE

TECHNICAL FIELD

The disclosure herein relates to the field of luminescence (e.g., electroluminescence); particularly, it relates to a method and apparatus for driving an electroluminescent device.

BACKGROUND

An electroluminescent device has been used in a wide range of applications due to their self-illuminating advantages. The electroluminescent device comprises an anode and a cathode, and an electroluminescent layer between the anode and the cathode. The electroluminescent device emits light due to electroluminescence of the electroluminescent layer.

A driver of the electroluminescent device may apply an electric current to the electroluminescent layer through the anode and the cathode causing the electroluminescent device to emit light. For example, the driver may drive the electroluminescent device in a direct current (DC) drive mode. In this DC drive mode, the driver applies a constant electric current (i.e., a direct current) to the electroluminescent layer through the anode and cathode.

SUMMARY

Disclosed herein is a method comprising: determining a first waveform of electric voltage based on a history of operation of an electroluminescent device, the history of operation comprising one or more parameters selected from a group consisting of durations of light emission of the electroluminescent device, intensities of light emission of the electroluminescent device, temperatures of the electroluminescent device during light emission, and combinations thereof; applying the first waveform of electric voltage to the electroluminescent device.

According to an embodiment, the first waveform is a pulse wave.

According to an embodiment, the method further comprises: updating the history of operation with information of operation of the electroluminescent device; determining a second waveform of electric voltage based on the updated history of operation; applying the second waveform of electric voltage to the electroluminescent device.

According to an embodiment, the information of operation of the electroluminescent device comprises a temperature of the electroluminescent device.

According to an embodiment, the second waveform is different from the first waveform.

According to an embodiment, the electroluminescent device is an organic light-emitting diode (OLED) or a quantum-dot light-emitting diode.

According to an embodiment, the electroluminescent device is a pixel of a display panel.

According to an embodiment, determining the first waveform comprises computing an effective light emission duration based on the history of operation.

According to an embodiment, determining the first waveform comprises selecting the first waveform from a plurality of waveforms based on the effective light emission duration.

According to an embodiment, computing the effective light emission duration comprises: determining a normalized duration based on the intensity of light emission and the temperature in each of the durations of light emission, wherein luminance attenuation of the electroluminescent device during that duration of light emission equals luminance attenuation of the electroluminescent device during the normalized duration in which the electroluminescent device is at a target temperature and has a target intensity of light emission; computing the effective light emission duration as a sum of the normalized durations.

According to an embodiment, determining the first waveform comprises determining a parameter of the first waveform, the parameter being selected from the group consisting of a duty cycle, a frequency and a spectral density.

According to an embodiment, the first waveform is a constant voltage.

According to an embodiment, the pulse wave has alternating polarities.

According to an embodiment, the pulse wave has a constant polarity.

According to an embodiment, the first waveform has a frequency in a range from 30 Hz to 360 Hz; wherein the first waveform has a duty cycle in a range from 30% to 99%; or wherein the first waveform has a minimum in a range from −0.01 V to −10 V.

Disclosed herein is a method comprising: obtaining a drive mode sequence comprising a sequential arrangement of at least two drive modes for driving an electroluminescent device to emit light; driving the electroluminescent device by sequentially applying the drive modes in the drive mode sequence.

According to an embodiment, the at least two drive modes are selected from a group consisting of a DC drive mode, a pulse drive mode, and an auxiliary drive mode; wherein, in the dc drive mode, a forward current is continuously applied to the electroluminescent device; wherein, in the pulse drive mode, pulses of a forward current are applied to the electroluminescent device and no current is applied to the electroluminescent device between adjacent pairs of the pulses; wherein, in the auxiliary drive mode, pulses of a forward current are applied to the electroluminescent device and a reverse current is applied to the electroluminescent device between adjacent pairs of the pulses, the reverse current having an absolute value smaller than an absolute value of the forward current.

According to an embodiment, the at least two drive modes consist of the pulse drive and the DC drive mode; or wherein the at least two drive modes consist of the pulse drive mode and the auxiliary drive mode; or wherein the at least two drive modes consist of the auxiliary drive mode and the DC drive mode.

According to an embodiment, the drive mode sequence begins with the pulse drive mode or the auxiliary drive mode.

According to an embodiment, obtaining the drive mode sequence further comprises, for each of the drive modes in the drive mode sequence, determining an effective light emission duration of the electroluminescent device and determining that each of the drive modes based on the effective light emission duration.

According to an embodiment, determining the effective light emission duration comprises determining normalized durations for time periods that are before that each of the drive modes.

Disclosed herein is a computer program product comprising a non-transitory computer readable medium having instructions recorded thereon, the instructions when executed by a computer implementing any of the methods above.

Disclosed herein is an apparatus comprising: a processor; a waveform generator; a memory; wherein the memory is configured to store a history of operation of an electroluminescent device, the history of operation comprising one or more parameters selected from the group consisting of durations of light emission of the electroluminescent device, intensities of light emission of the electroluminescent device, temperatures of the electroluminescent device during light emission and combinations thereof; wherein the processor is configured to determine a first waveform of electric voltage based on the history of operation stored in the memory; wherein the waveform generator is configured to generate the first waveform of electric voltage and apply the first waveform to the electroluminescent device.

According to an embodiment, the processor is configured to update the history of operation, with information of operation of the electroluminescent device; wherein the processor is configured to determine a second waveform of electric voltage based on the updated history of operation of the electroluminescent device; wherein the waveform generator is configured to generate the second waveform of electric voltage and apply the second waveform to the electroluminescent device.

According to an embodiment, the apparatus further comprises a temperature sensor; wherein the information of operation of the electroluminescent device comprises a temperature of the electroluminescent device measured by the temperature sensor.

According to an embodiment, the processor is configured to determine the first waveform by computing an effective light emission duration based on the history of operation.

According to an embodiment, the processor is configured to determine the first waveform by selecting the first waveform from a plurality of waveforms based on the effective light emission duration.

According to an embodiment, the processor is configured to compute the effective light emission duration by: determining a normalized duration based on the intensity of light emission and the temperature in each of the durations of light emission, wherein luminance attenuation of the electroluminescent device during that duration of light emission equals luminance attenuation of the electroluminescent device during the normalized duration in which the electroluminescent device is at a target temperature and has a target intensity of light emission; computing the effective light emission duration as a sum of the normalized durations.

Disclosed herein is a display panel comprising any of the above apparatuses.

DETAILED DESCRIPTION

An electroluminescent device (e.g., an organic light-emitting diode (OLED or quantum dot light-emitting diode) typically emits light by being driven with a driver. Although methods and apparatuses will be described herein for driving an electroluminescent device or an OLED, the methods and apparatuses may also be applicable for driving other types of light-emitting diode (LED).

Figure 1:
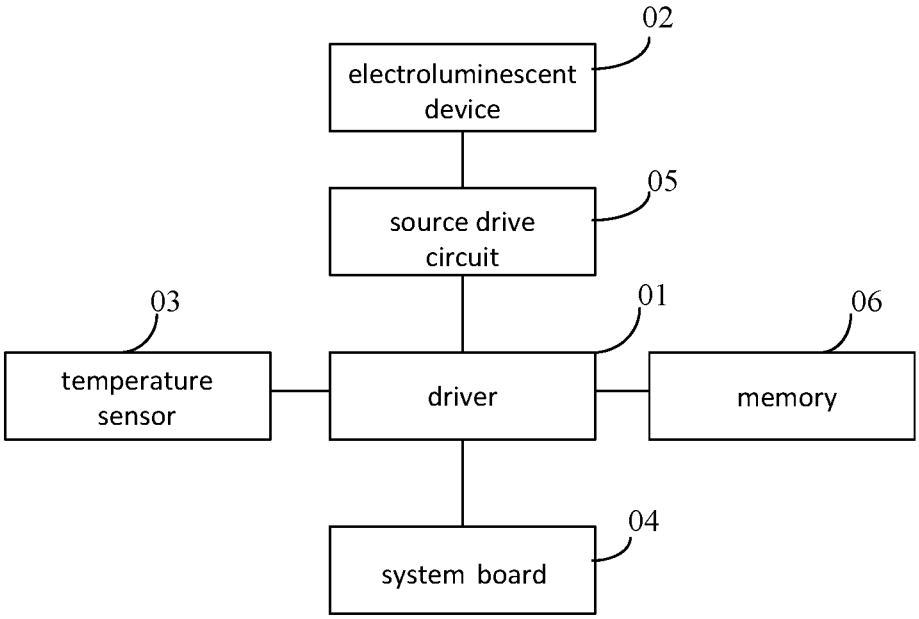
FIG. 1 schematically shows an application scenario for the driver, according to an embodiment.

FIG. 1 schematically shows an application scenario for a driver, according to an embodiment. As shown in FIG. 1, a driver 01 is electrically connected to an electroluminescent device 02, and may be used to drive the electroluminescent device 02 to emit light. The electroluminescent device 02 may be any device capable of electroluminescence. For example, the electroluminescent device may be an organic light-emitting diode, and the electroluminescent device may also be other electroluminescent devices, such as quantum dot electroluminescent device or a perovskite electroluminescent device.

Figure 2:
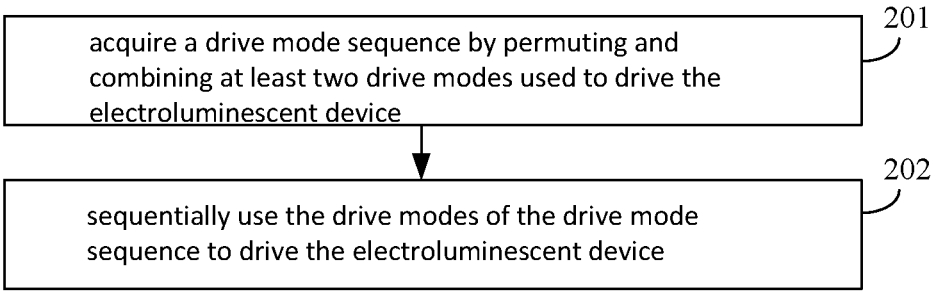
FIG. 2 schematically shows a flowchart of a drive method of an electroluminescent device, according to an embodiment.

FIG. 2 schematically shows a flowchart of a method for driving an electroluminescent device, according to an embodiment. The method may be used for the driver 01 of FIG. 1. As shown in FIG. 2, the method may include the following procedures.

In procedure 601, a drive mode sequence is acquired by permuting and combining at least two drive modes used to drive the electroluminescent device.

In procedure 602, the drive modes of the drive modes sequence are sequentially used to drive the electroluminescent device.

For example, suppose that the drive modes sequence acquired in procedure 601 is: {drive mode 1, drive mode 2, drive mode 1, drive mode 2, drive mode 3}, the driver may sequentially use drive mode 1, drive mode 2, drive mode 1, drive mode 2, and drive mode 3 to drive the electroluminescent device in procedure 602.

The driver may acquire the drive mode sequence by permuting and combining at least two drive modes used to drive the electroluminescent device to emit light, and may drive the electroluminescent device based on a mixed plurality of drive modes in the drive mode sequence. In this way, the driver may use a mixed plurality of drive modes to drive the electroluminescent device, thereby enriching the drive modes of the electroluminescent device.

Optionally, the drive mode sequence may be acquired by permuting and combining at least two drive modes, and the at least two drive modes may be any two drive modes. In some of the examples herein, the at least two drive modes may include a DC drive mode, a pulse drive mode, and an auxiliary drive mode as an example.

Before explaining the drive method of the electroluminescent device, the DC drive mode, the pulse drive mode, and the auxiliary drive mode will be explained first.

Figure 3:
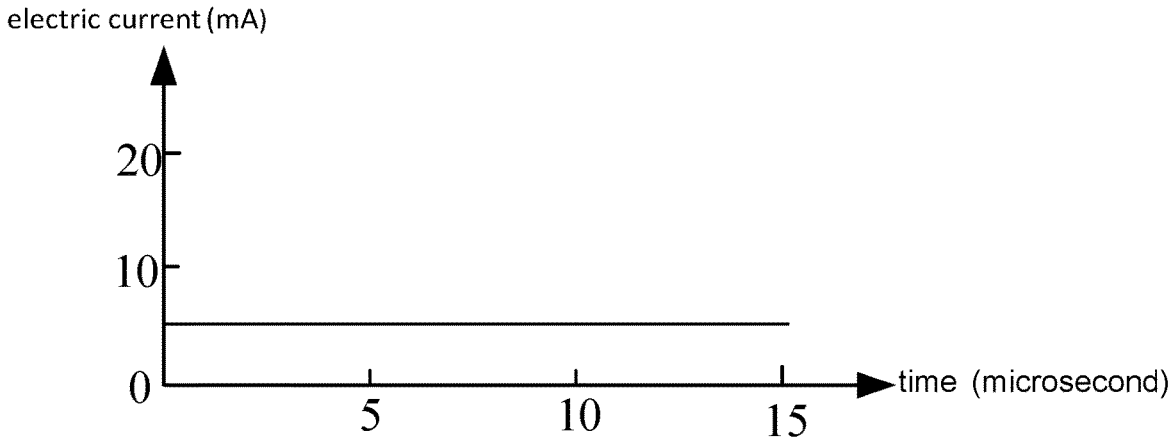
FIG. 3 schematically shows a DC drive mode, according to an embodiment.

In the DC drive mode, the driver applies a forward electric current to the electroluminescent device. For example, as schematically shown in FIG. 3, when the driver drives the electroluminescent device in the DC drive mode, the electric current applied by the driver to the electroluminescent device is always a constant value greater than zero (i.e., the value of the electric current is always the constant value greater than zero). The electric current having a positive value means that the electroluminescent device is under a forward bias when the electric current flows through the electroluminescent device. The constant value of 5 milliampere (mA) is taken as an example in FIG. 3. The horizontal axis in FIG. 3 is time, whose unit is microsecond, and the vertical axis is electric current, whose unit is mA.

Figure 4:
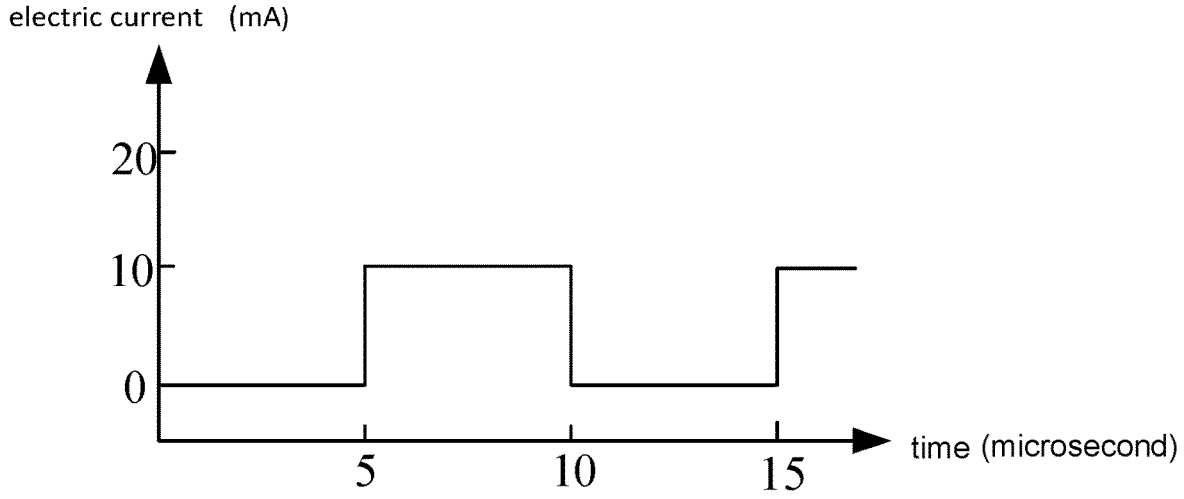
FIG. 4 schematically shows a pulse drive mode, according to an embodiment.

In the pulse drive mode, the driver periodically applies a forward electric current to the electroluminescent device, and stop applying the electric current to the electroluminescent device during an interval period between any two adjacent application periods of the forward current. For example, as schematically shown in FIG. 4, when the driver drives the electroluminescent device in a pulse drive mode, the driver periodically applies the forward current to the electroluminescent device (e.g., continuously applying the forward current for 5 microseconds every 5 microseconds). Then the driver stops applying the electric current to the electroluminescent device during the interval period between any two adjacent application periods of the forward current, such as the interval period (5 microseconds) between the application periods of the forward current every two times in FIG. 4, in which the electric current applied by the driver to the electroluminescent device is zero. The horizontal axis in FIG. 4 is time whose unit is microsecond. The vertical axis in FIG. 4 is electric current whose unit is mA.

Figure 5:
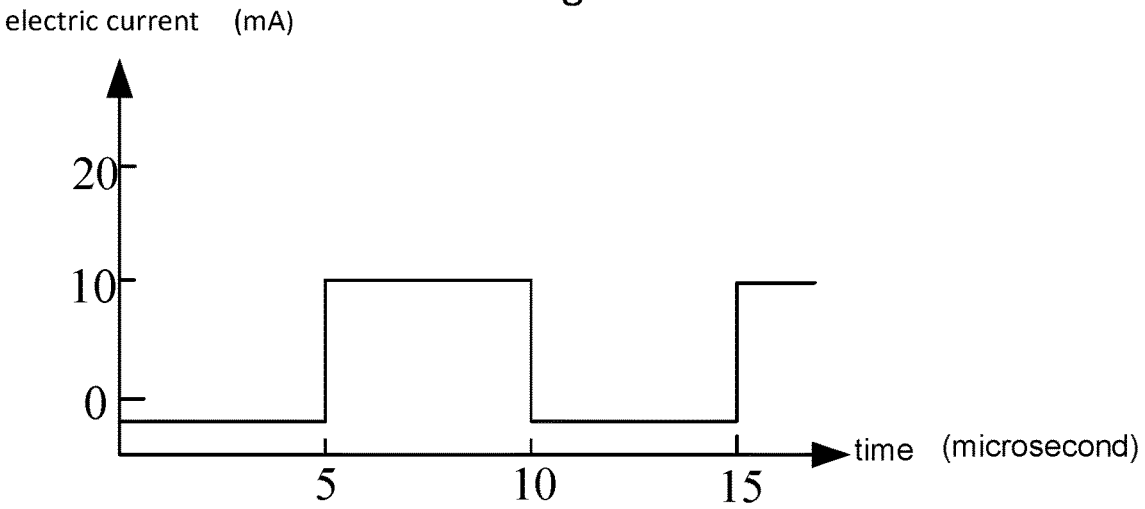
FIG. 5 schematically shows an auxiliary drive mode, according to an embodiment.

In the auxiliary drive mode, the driver periodically applies a forward electric current to the electroluminescent device, and apply a reverse electric current during the interval period between any two adjacent application periods of the forward current. The absolute value of the reverse current is less than the absolute value of the forward current. For example, as schematically shown in FIG. 5, when the driver drives the electroluminescent device in a pulse drive mode, the driver periodically applies a forward current to the electroluminescent device (e.g., continuously applying a forward current for 5 microseconds every 5 microseconds). Then the driver applies a reverse current to the electroluminescent device during the interval period between any two adjacent application periods of the forward current, such as the interval period (5 microseconds) between the application periods of the forward current in FIG. 5, in which the electric current applied by the driver to the electroluminescent device is less than zero. The horizontal axis in FIG. 5 is time whose unit is microsecond. The vertical axis in FIG. 5 is electric current whose the unit is mA.

The forward electric current applied by the driver to the electroluminescent device should be smaller than the forward breakdown current of the electroluminescent device. The reverse electric current applied by the driver to the electroluminescent device should be greater than the reverse breakdown current of the electroluminescent device. The absolute value of the reverse electric current applied by the driver to the electroluminescent device should be less than the absolute value of the reverse breakdown current of the electroluminescent device. The forward voltage applied by the driver to the electroluminescent device (the electric voltage corresponding to the forward current, which is used to generate the forward electric current) should be less than the forward breakdown voltage of the electroluminescent device. The reverse voltage applied by the driver to the electroluminescent device (the electric voltage corresponding to the reverse electric current, which is used to generate the reverse electric current) should be greater than the reverse breakdown voltage of the electroluminescent device. The absolute value of the reverse voltage applied by the driver to the electroluminescent device should be less than the absolute value of the reverse breakdown voltage of the electroluminescent device.

The electric voltage corresponding to the reverse electric current may be in a range from −0.01 V to −10 V. The electric voltage corresponding to the reverse electric current may also be in other ranges, such as from −0.5 V to −15 V.

In the pulse drive mode or the auxiliary drive mode, the driver may apply a forward current with a frequency in a range from 30 Hz to 360 Hz to the electroluminescent device. The frequency of the forward electric current may also be in other ranges, such as, from 50 Hz to 300 Hz.

In the pulse drive mode or the auxiliary drive mode, the driver may apply a forward electric current with a duty cycle in a range from 30% to 99% to the electroluminescent device. The duty cycle of the forward electric current may also be in other ranges, such as from 25% to 85%. The duty cycle of the electric current is: the proportion of the duration of the forward electric current. For example, as shown in FIG. 4, the duration of the forward electric current is 5 microseconds in each cycle (i.e., the period of the applied electric current, 10 microseconds). Therefore, the duty cycle of the forward current in FIG. 4 is 5/10=50%. For another example, suppose that each electric current period is 20 microseconds, the duration of the forward current is 5 microseconds in the electric current period, and the duty cycle of the forward current is 20%.

Figure 6:
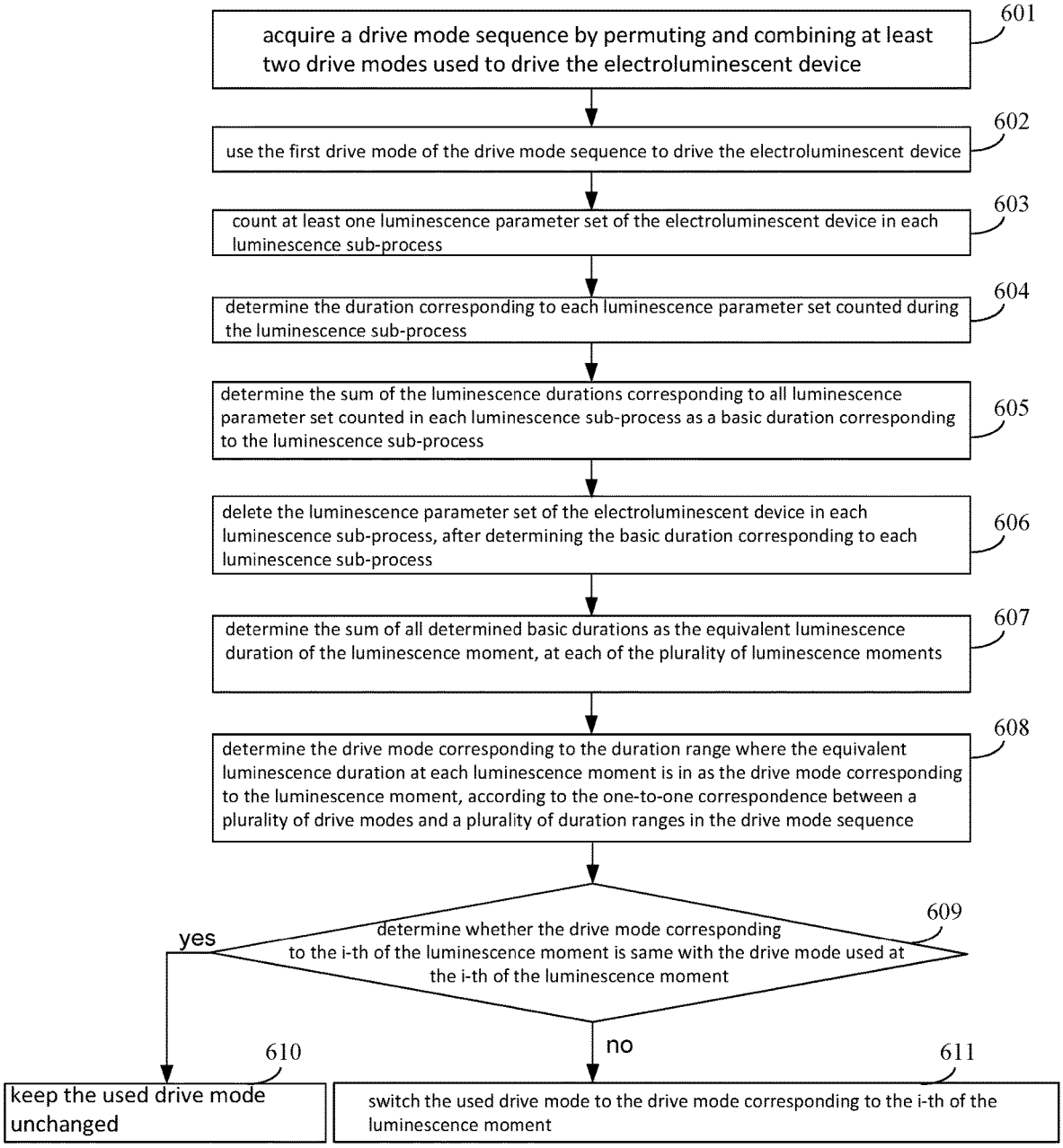
FIG. 6 schematically shows a flowchart of the drive method of another electroluminescent device, according to an embodiment.

FIG. 6 shows the flowchart of a method for driving another electroluminescent device, according to an embodiment. This method may also be applied to the driver 01 of the electroluminescent device 02 shown in FIG. 1. As shown in FIG. 6, the drive method includes the following procedures.

In procedure 601, the drive mode sequence is acquired by permuting and combining at least two drive modes used to drive the electroluminescent device.

Optionally, in procedure 601, the driver may directly acquire a drive mode sequence input by the user; or the driver may acquire at least two drive modes input by the user, and acquire a drive mode sequence by arranging and combining the at least two drive modes; or the driver may acquire the drive mode sequence sent by other devices; or the driver may acquire at least two drive modes sent by other devices, and acquire a drive mode sequence by arranging and combining the at least two drive modes.

Optionally, the drive modes in the drive mode sequence may comprise: a first drive mode and a second drive mode. For example, the first drive mode is a pulse drive mode, and the second drive mode is a DC drive mode; or the first drive mode is a pulse drive mode, and the second drive mode is an auxiliary drive mode; or the first drive mode is an auxiliary drive mode, and the second drive mode is a DC drive mode.

Optionally, the drive mode sequence is formed by alternately arranging by the first drive mode and the second drive mode, and the first drive mode of the drive mode sequence is a pulse drive mode or an auxiliary drive mode. For example, when the first drive mode is the pulse drive mode, and the second drive mode is the DC drive mode, the drive mode sequence may be: {pulse drive mode, DC drive mode}; when the first drive mode is a pulse drive mode, and the second drive mode is the auxiliary drive mode, the drive mode sequence may be: {pulse drive mode, auxiliary drive mode} or {auxiliary drive mode, pulse drive mode}, etc.; when the first drive mode is the auxiliary drive mode, and the second drive mode is the DC drive mode, the drive mode sequence may be: {auxiliary drive mode, DC drive mode}.

In procedure 602, the first drive mode of the drive mode sequence is used to drive the electroluminescent device.

The driver may drive the electroluminescent device by sequentially using a plurality of the drive modes in the drive mode sequence, after acquiring the drive mode sequence. Wherein, the driver may determine that it is currently necessary to drive the electroluminescent device by using the first drive mode of the drive mode sequence to cause the electroluminescent device to emit light, at the beginning of driving the electroluminescent device.

In procedure 603, at least one luminescence parameter set of the electroluminescent device is counted in each luminescence sub-process.

The process by which the electroluminescent device is driven to emit light may comprise a plurality of the luminescence sub-processes, and the driver may count at least one of the luminescence parameter sets in each luminescence sub-process during the luminescence process of the electroluminescent device. For example, each luminescence sub-process may last for 5 seconds (or 2 seconds, 3 seconds, etc.), and the driver may count the luminescence parameter set for the electroluminescent device within every 5 seconds.

Each luminescence parameter set may comprise: an ambient temperature (i.e., the temperature of the environment in which the light emitting device is located when the electroluminescent device emits light) and an luminance (i.e., the luminance of the light emitted by the electroluminescent device), and an duration that the electroluminescent device emits light of the luminance at the ambient temperature (cumulative duration). At least one of the ambient temperatures and luminance in different luminescence parameter sets may be different.

For example, the luminescence parameter set in a certain luminescence sub-process counted by the driver may comprise a luminescence parameter set 1, a luminescence parameter set 2, and a luminescence parameter set 3. Wherein, the luminescence parameter set 1 may comprise: an ambient temperature (30 degrees Celsius), a luminance (100 candela), and a duration (3 seconds), namely, the duration of the light emitted by the electroluminescent device with a luminance of 100 candelas reaches total 3 seconds during the luminescence sub-process at an ambient temperature of 30 degrees Celsius. The luminescence parameter set 2 may comprise: an ambient temperature (30 degrees Celsius), a luminance (90 candelas), and a duration (1 second), namely, the duration of the light emitted by the electroluminescent device with a luminance of 90 candelas reaches total 1 seconds during the luminescence sub-process at an ambient temperature of 30 degrees Celsius. The luminescence parameter set 3 may comprise: an ambient temperature (29 degrees Celsius), a luminance (90 candelas), and a duration (1 sec), namely, the duration of the light emitted by the electroluminescent device with a luminance of 90 candelas reaches total 1 second during the luminescence sub-process at an ambient temperature of 29 degrees Celsius.

Optionally, referring to FIG. 1, the driver 01 of the electroluminescent device 02 may be connected to a temperature sensor 03, and the temperature of the ambient light when the electroluminescent device 02 emits light may be detected by the temperature sensor 03. In addition, the driver 01 of the electroluminescent device 02 may also be connected to a system board 04, and connected to the electroluminescent device 02 via a source drive circuit 05. The system board 04 is configured to transmit indication information of the luminance of the light that the electroluminescent device 02 should emit to the driver 01, so that the driver 01 may drive the electroluminescent device 02 through the source drive circuit 05 in accordance based on the indication information. At that time, the driver 01 may determine the luminance of the light emitted from the electroluminescent device 02 based on the indication information transmitted by the system board 04.

Optionally, the system board 04 may comprise a substrate, and a system on chip (SOC) arranged on the substrate, the system board 04 may further comprise other devices arranged on the substrate.

In procedure 604, the duration corresponding to each luminescence parameter set counted during the luminescence sub-process is determined.

For each luminescence parameter set, when the electroluminescent device emits light under the parameter of the luminescence parameter set, the amount of the luminance attenuation of the electroluminescent device is the first amount of the luminance attenuation. The amount of the luminance attenuation of the light emitted by the electroluminescent device under the parameter of the luminescence parameter set is equivalent to the amount of intensity attenuation of the light that maintains the duration parameter of the luminescence parameter set, wherein the light is emitted by the electroluminescence device at the ambient temperature parameter of the luminescence parameter set, and the luminance of the light is the luminance parameter of the luminescence parameter set.

When the electroluminescent device emits the light with the target luminance at the target ambient temperature, and the duration of the light reaches the luminescence duration parameter of the luminescence parameter set, the electroluminescent device also has a first amount of the luminance attenuation. Namely, the electroluminescent device emits the light under the parameter setting of the illuminating parameter set, which is equivalent to the length of time ("normalized duration") that the electroluminescent device emits the target luminance at the target temperature to reach the illuminating parameter set. In other words, the normalized duration for a duration of light emission of the electroluminescent device is the time period during which the electroluminescent device is at a target temperature and has a target intensity of light emission and during which the electroluminescent device has the same luminance attenuation as during that duration of light emission.

For example, suppose that a certain luminescence parameter set includes: ambient temperature (30 degrees Celsius), luminance (100 candela), and duration (3 seconds), the target ambient temperature is 20 degrees Celsius, and the target luminance is 50 candelas, then duration corresponding the luminescence parameter set may be calculated by combining the luminescence parameter set, the target ambient temperature, the target luminance, and the Arrhenius formula. The duration corresponding to the luminescence parameter set is also the duration that the electroluminescent device emits the light with the luminance at 50 candelas for 3 seconds at a temperature of 20 degrees Celsius, while the amount of the luminance attenuation of the light is an amount of the luminance attenuation of that the electroluminescent device emits the light with the luminance at 100 candelas for 3 seconds at an ambient temperature of 30 degrees Celsius.

For example, a certain luminescence parameter set includes: ambient temperature (25 degrees Celsius), luminance (luminance of 255 gray scales), and duration (100 hours), the target ambient temperature is 25 degrees Celsius, and the target luminance is 255 grayscale luminance, then it may be determined that the duration corresponding to the luminescence parameter set is 100 hours. For example, a certain luminescence parameter set includes: ambient temperature (25 degrees Celsius), luminance (64 grayscale luminance), and duration (100 hours), the target ambient temperature is 25 degrees Celsius, and the target luminance is 255 grayscale luminance, then it may be determined that the duration corresponding to the luminescence parameter set is about 12.5 hours. For example, a certain luminescence parameter set includes: ambient temperature (45 degrees Celsius), luminance (255 grayscale luminance), and duration (40 hours), the target ambient temperature is 25 degrees Celsius, and the target luminance is 255 grayscale luminance, then it may be determined that the duration corresponding to the luminescence parameter set is about 100 hours.

The electroluminescence device having a certain amount of the luminance attenuation Lx at a certain time t may have multiple meanings. For example, the difference between the highest luminance L (0) of the light when the electroluminescent device is not used and the highest luminance L (t) of the light emitted by the electroluminescent device at the time t is Lx. Or, L (t)/L (0) is equal to the ratio y, and Lx=L (0) (1−y) may be considered at this time.

In procedure 605, the sum of the luminescence durations corresponding to all luminescence parameter set counted in each luminescence sub-process is determined as a basic duration corresponding to the luminescence sub-process.

After the driver determines the duration corresponding to each luminescence parameter set counted in each luminescence sub-process, the driver may determine the sum of the durations corresponding to all luminescence parameter sets counted in the luminescence sub-process as the basic duration corresponding to the luminescence sub-process. At this time, in the luminescence sub-process, the amount of luminance attenuation of the electroluminescent device is equivalent to: the amount of luminance attenuation of the electroluminescent device, when the luminescence duration of the light emitted by the electroluminescent device with the target luminance at the target ambient temperature reaches the basic duration corresponding to the luminescence sub-process.

Optionally, referring to FIG. 1, the driver 01 may also be connected to the memory 06. The driver 01 may store the basic duration through the memory 06, after determining the basic duration corresponding to one luminescence sub-process every time.

In procedure 606, the luminescence parameter set of the electroluminescent device in each luminescence sub-process is deleted, after determining the basic duration corresponding to each luminescence sub-process.

The driver may delete all luminescence parameter sets counted in a luminescence sub-process to reduce the storage load on the driver, after determining the basic duration corresponding to the luminescence sub-process every time.

In procedure 607, the sum of all determined basic durations is determined as the effective light emission duration of the luminescence moment, at each of the plurality of luminescence moments.

A plurality of luminescence moments may be preset in the driver, and at each luminescence moment, the driver may determine the sum of all determined basic durations and use the sum as the effective light emission duration of the electroluminescent device at the luminescence moment. At this time, the amount of luminance attenuation of the electroluminescent device at a certain luminescence moment is equivalent to: at the target ambient temperature, the amount of luminance attenuation of the electroluminescent device when the duration of the light of the target luminance that is emitted by the electroluminescent device reaches the effective light emission duration at a certain luminescence moment.

In Procedure 608, the drive mode corresponding to the duration range where the effective light emission duration at each luminescence moment is in as the drive mode corresponding to the luminescence moment is determined, according to the one-to-one correspondence between a plurality of drive modes and a plurality of duration ranges in the drive mode sequence.

For example, the one-to-one correspondence between the plurality of drive modes and the plurality of duration ranges in the drive mode sequence may be preset in the driver. Optionally, the driver may store the correspondence by storing a lookup table (LUT). Optionally, in the correspondence, the duration in the duration range corresponding to the drive mode is positively correlated with the order of the drive mode of the drive mode sequence.

For example, the one-to-one correspondence between the plurality of drive modes and the plurality of duration ranges may be as shown in Table 1, the drive mode sequence is {auxiliary drive mode, DC drive mode}, wherein the duration corresponding to the auxiliary drive mode is (0 hour, 500 hours], the duration corresponding to the DC drive mode is (500 hours, Go hours). Go means infinity. Because the auxiliary drive mode is ranked before the DC drive mode of the drive mode sequence, that is, the order of the auxiliary drive mode (1) is smaller than the order of the DC drive mode (2), and therefore, the duration in the duration range corresponding to the auxiliary drive mode is smaller than the duration in the duration range corresponding to the DC drive mode.

TABLE 1

| Order of the drive mode of the drive mode sequence | Drive mode of the drive mode sequence | Duration range |
|---|---|---|
| 1 | Auxiliary drive mode | (0 hour, 500 hours] |
| 2 | DC drive mode | (500 hours, ∞ hours) |

When the driver determines the effective light emission duration of the luminescence moment every time, the driver may determine the drive mode corresponding to the duration range where the effective light emission duration is in at the luminescence moment as the drive mode corresponding to the luminescence moment, according to the one-to-one correspondence between the plurality of drive modes and the plurality of duration ranges. The drive mode is determined as the drive mode corresponding to the luminescence moment. For example, suppose that the driver determines that the effective light emission duration is 501 hours at a certain luminescence moment, it may be determined that the duration range corresponding to the luminescence moment is (500 hours, Go hours), and the drive mode corresponding to the luminescence moment is the DC drive mode, according to the correspondence. Suppose that, the driver determines that the driver determines that the effective light emission duration is 20 hours at a certain luminescence moment, it may be determined that the duration range corresponding to the luminescence moment is (0 hour, 500 hours], and the drive mode corresponding to the luminescence moment is the auxiliary drive mode, according to the correspondence.

In procedure 609, whether the drive mode corresponding to the i-th of the luminescence moment is same with the drive mode used at the i-th of the luminescence moment is determined. If the drive mode corresponding to the i-th of the luminescence moment is same with the drive mode used at the i-th of the luminescence moment, procedure 610 is performed. If the drive mode corresponding to the i-th of the luminescence moment is not same with the drive mode used at the i-th of the luminescence moment, procedure 611 is performed.

Wherein, i≥1. After the driver determines the drive mode corresponding to a luminescence moment every time, the driver may compare the drive mode to the drive mode actually used by the driver at the luminescence moment to determine whether the actually used drive mode is the drive mode corresponding to the luminescence moment.

In procedure 610, the used drive mode is kept unchanged.

When the drive mode corresponding to the i-th of the luminescence moment is same with the drive mode actually used to drive the electroluminescent device at the i-th of the luminescence moment, the driver may continue driving the electroluminescent device with the drive mode currently used.

For example, suppose that the driver determines that the effective light emission duration corresponding to a certain luminescence moment is 20 hours, and the drive mode corresponding to the luminescence moment is the auxiliary drive mode. The driver may continue driving the electroluminescent device with the auxiliary drive mode, if the drive mode used by the driver to drive the electroluminescent device at the luminescence moment is the auxiliary drive mode.

In procedure 611, switch the used drive mode to the drive mode corresponding to the i-th of the luminescence moment.

When the drive mode corresponding to the i-th of the luminescence moment is different with the drive mode actually used by the driver to drive the electroluminescent device at the luminescence moment, the driver switches the drive mode currently used to the drive mode corresponding to the i-th lighting moment.

For example, suppose that the driver determines that the effective light emission duration corresponding to a certain luminescence moment is 501 hours, and the drive mode corresponding to the luminescence moment is the DC drive mode. If the drive mode used by the driver to drive the electroluminescent device at the luminescence moment is still the auxiliary drive mode, the driver may switch the auxiliary drive mode to the DC drive mode.

The driver may use the first drive mode of the drive mode sequence, when the driver drives the electroluminescent device initially. During the process of emitting the light by the electroluminescent device, the driver needs to collect the luminescence parameter set of the electroluminescent device, and determine the basic duration corresponding to each illuminating sub-process, according to the collected luminescence parameter set. And, the driver also needs to determine whether it is necessary to switch the drive mode at each of the plurality of luminescence moments, according to all basic durations that have been determined (for example, perform the determining step as shown in procedure 609). When it is not required to switch the drive mode, the current drive mode is still used to drive the electroluminescent device; when it is required to switch the drive mode, the current drive mode is switched.

The driver may acquire the drive mode sequence by permuting and combining at least two drive modes used to drive the electroluminescent device to emit light, and may drive the electroluminescent device based on a mixed plurality of drive modes in the drive mode sequence. In this way, the driver may use a mixed plurality of drive modes to drive the electroluminescent device, thereby enriching the drive modes of the electroluminescent device.

Using the mixed plurality of drive modes to drive the electroluminescent device may increase the lifetime of the electroluminescent device.

For example, there are three options of the drive modes in the drive mode sequence, such as DC drive mode, pulse drive mode, and auxiliary drive mode. The effect of each of the three drive modes on the lifetime of the electroluminescent device will be explained below.

To demonstrate the effect of each drive mode on the lifetime of the electroluminescent device, a plurality of organic light-emitting diodes (OLED) devices (an electroluminescent device) may be made, which are respectively an OLED device A1, an OLED device B1, an OLED device C1, and an OLED device D1. Each of the four OLED devices may be controlled independently, and the structure, material, production method, and production time of the four OLED devices are the same, namely, the four OLED devices have the same characteristics, and there is no inter-chip difference.

Figure 7:
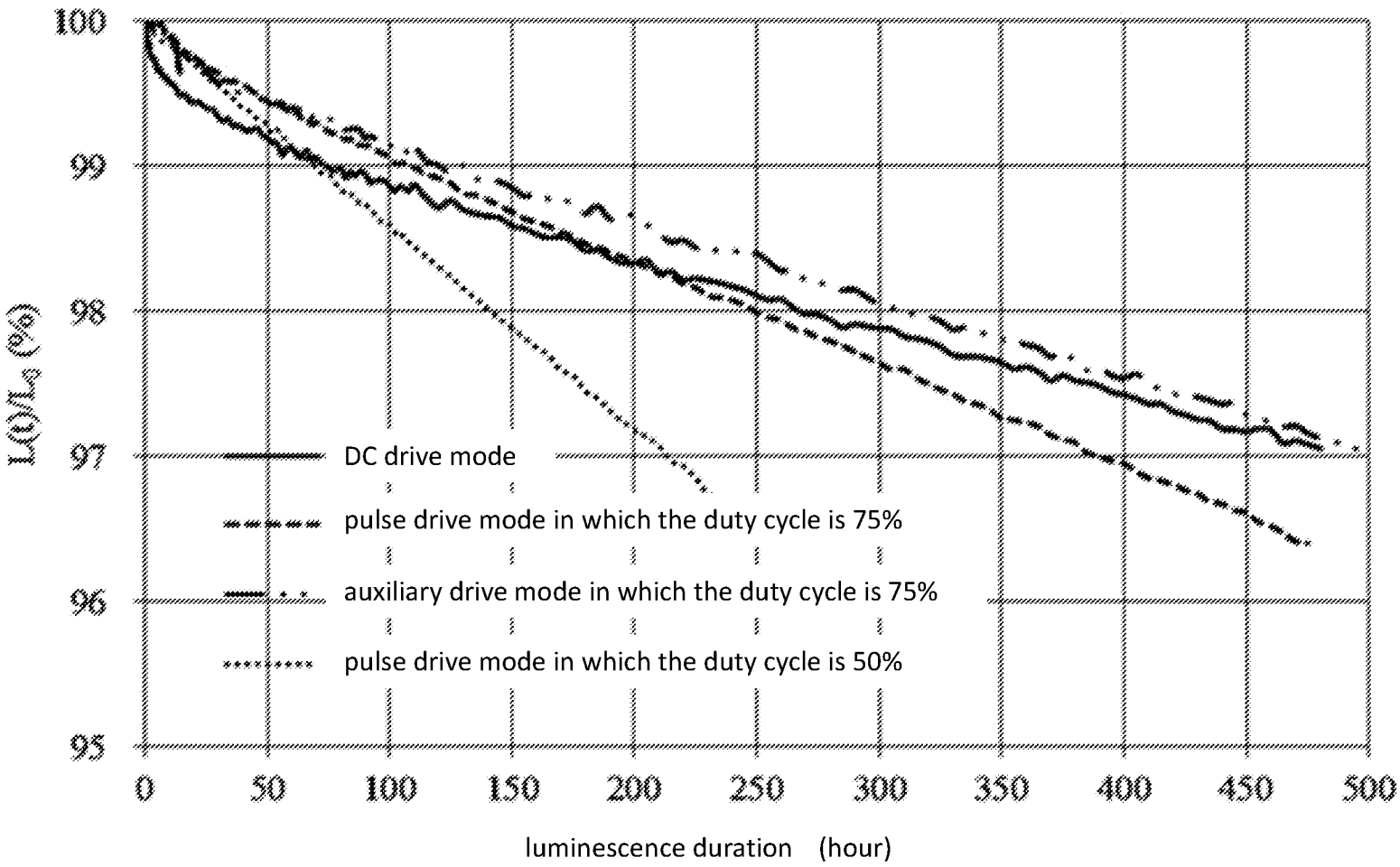
FIG. 7 schematically shows a life attenuation curve, according to an embodiment.

Optionally, the color coordinates of the four OLED devices at a certain current density and a certain electric current efficiency may be shown in Table 2. After performing the lifetime tests on the four OLED devices separately, the lifetime tests results can be obtained as shown in Table 3, and the lifetime attenuation curves as shown in FIG. 7. It should be illustrated that, in Table 2, CIE represents Commission Internationale de L'Eclairage; CIEx represents the abscissa in the chromaticity diagram developed by the CIE; CIEy represents the ordinate in the chromaticity diagram developed by the CIE. In Table 3, the drive mode refers to the drive mode used to apply an electric current to the OLED device during the lifetime testing of the OLED device; the duty cycle refers to the duty cycle of the forward current applied during the lifetime testing of the OLED device; the initial luminance is the luminance of the light emitted when the OLED device is not used, and the initial luminance can be obtained by multiplying the current density by the current efficiency and converting the unit; the lifetime t97 refers to the luminescence duration that luminance of the light that is emitted by the OLED device attenuates to 97% of the initial luminance.

TABLE 2

| OLED device | Current density (mA/cm$^2$) | Current efficiency (candela/A) | CIEx | CIEy |
|---|---|---|---|---|
| A1 | 15 | 7.88 | 0.1359 | 0.0488 |
| B1 | 20 | 7.88 | 0.1359 | 0.0488 |
| C1 | 30 | 7.82 | 0.1359 | 0.0487 |
| D1 | 20 | 7.86 | 0.1360 | 0.0486 |

TABLE 3

| OLED device | Drive mode | Duty cycle | Current density (mA/cm$^2$) | Initial luminance (candela/m$^2$) | lifetime t97(hour) |
|---|---|---|---|---|---|
| A1 | DC drive mode | 100% | 15 | 1182 | 490 |
| B1 | Pulse drive mode | 75% | 20 | 1182 | 390 |
| C1 | Pulse drive mode | 50% | 30 | 1173 | 213 |
| D1 | Auxiliary drive mode | 75% | 20 | 1176 | 504 |

As shown in Table 3, for the OLED device A1, the DC drive mode may be used to drive the OLED device A1. Since the driver is configured to continuously apply a forward current to the OLED device A1 in the DC drive mode, the duty cycle of the forward current is 100%. It can be concluded from the test that the luminescence duration that luminance of the light that is emitted by the OLED device A1 attenuates to 97% of the initial luminance is 490 hours. For the OLED device B1, it may be driven by the pulse drive mode in which the duty cycle of the forward current is 75%. It can be concluded from the test that the luminescence duration that luminance of the light that is emitted by the OLED device B1 attenuates to 97% of the initial luminance is 390 hours. For the OLED device C1, it may be driven by the pulse drive mode in which the duty cycle of the forward current is 50%. It can be concluded from the test that the luminescence duration that the luminescence duration that luminance of the light that is emitted by the OLED device B1 attenuates to 97% of the initial luminance is 213 hours. For the OLED device D1, it may be driven by the auxiliary drive mode in which the duty cycle of the forward current is 75%. It can be concluded from the test that the luminescence duration that luminance of the light that is emitted by the OLED device D1 attenuates to 97% of the initial luminance is 504 hours.

In addition, the abscissa of FIG. 7 is the luminescence duration (the unit is hour) of the OLED device, the ordinate is L(t)/L(0), and the unit is % (percent), and L(t) is the luminance of the light by emitted by the OLED device emits light for the luminescence duration t, L(0) is the initial luminance of the OLED device, and the slope of the curve shown in FIG. 7 at any point may indicate the luminance attenuation speed at that point.

FIG. 7 shows that, in the short-time drive phase (for example, 0 hour to 50 hours), the luminance attenuation speed when the OLED device is driven by the pulse drive mode is smaller than the luminance attenuation speed when the OLED device is driven by the DC drive mode; the luminance attenuation speed when the OLED device is driven by the auxiliary drive mode is also smaller than the luminance attenuation speed when the OLED device is driven by the DC drive mode. In the long-term drive phase (for example, after 50 hours), the luminance attenuation speed when the OLED device is driven by the DC drive mode is smaller than the luminance attenuation speed when the OLED device is driven by the pulse drive mode; the luminance attenuation speed when the OLED device is driven by the auxiliary drive mode is smaller than the luminance attenuation speed when the OLED device is driven by the DC drive mode. Therefore, it can be concluded that, in the short-time drive phase, the luminance attenuation speed when the OLED device is driven by the pulse drive mode or by the auxiliary drive mode is smaller; in the long-time drive phase, the luminance attenuation speed when the OLED device is driven by the DC drive mode is smaller, and the luminance attenuation speed when the OLED device is driven by the auxiliary drive mode is smallest.

Therefore, if the OLED device is driven by the pulse drive mode or by the auxiliary drive mode in the short-time drive phase, and the OLED device is driven by the DC drive mode or by the auxiliary drive mode in the long-time drive phase, the luminance attenuation speed of the OLED device may keep slower in the entire drive process. Moreover, the lifetime of the OLED device may be longer when the luminance attenuation speed is slower. Therefore, the attenuation speed of the electroluminescent device may be slower and the lifetime of the electroluminescent device may be longer, if the drive mode sequence is {pulse drive mode, DC drive mode}, {pulse drive mode, auxiliary drive mode}, or {auxiliary drive mode, DC drive mode}.

The drive effect of the drive modes of the electroluminescent device will be explained below. For example, in order to verify the effect of each drive mode on the lifetime of the electroluminescent device, a plurality of OLED devices (an electroluminescent device) that can emit blue light may be made, which are respectively an OLED device A2, an OLED device B2, and an OLED device C2. Each of the three OLED devices may be controlled independently, and the structure, material, production method, and production time of the three OLED devices are the same, and there is no inter-chip difference.

Figure 8:
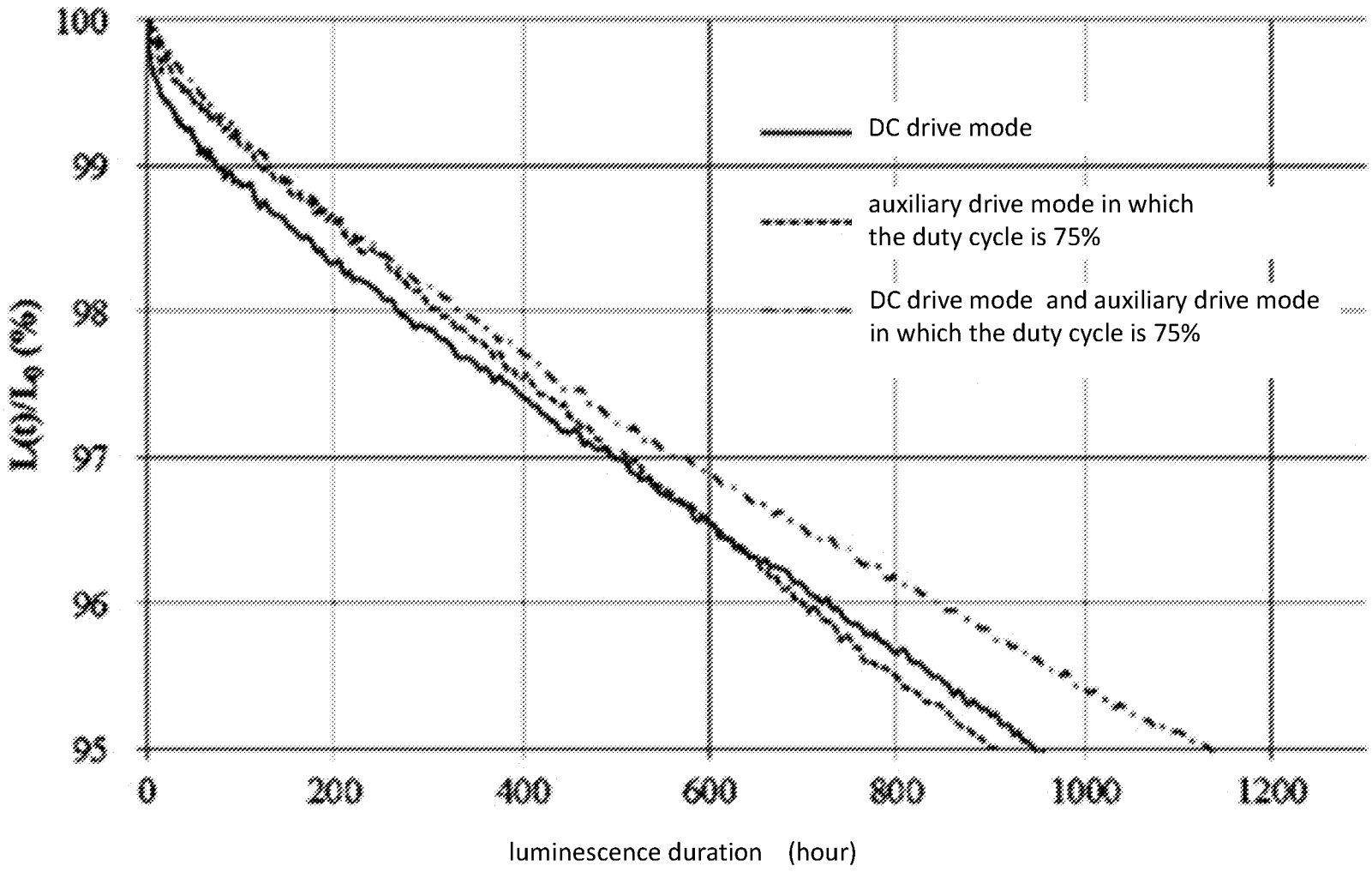
FIG. 8 schematically shows another life attenuation curve, according to an embodiment.

The color coordinates of the three OLED devices at a certain current density and a certain electric current efficiency may be shown in Table 4. After performing the lifetime tests on each of the three OLED devices separately, the lifetime tests results can be obtained as shown in Table 5, and the lifetime attenuation curves as shown in FIG. 8. It should be illustrated that, in Table 5, the lifetime t97 refers to the luminescence duration that luminance of the light that is emitted by the OLED device attenuates to 97% of the initial luminance. In Table 5, the lifetime t95 refers to the luminescence duration that luminance of the light that is emitted by the OLED device attenuates to 95% of the initial luminance.

TABLE 4

| OLED device | Current density (mA/cm$^2$) | Current efficiency (candela/A) | CIEx | CIEy |
|---|---|---|---|---|
| A2 | 15 | 8.11 | 0.1352 | 0.0501 |
| A2 | 20 | 8.08 | 0.1352 | 0.0501 |
| B2 | 15 | 8.14 | 0.1351 | 0.0503 |
| B2 | 20 | 8.14 | 0.1351 | 0.0504 |
| C2 | 15 | 7.96 | 0.1352 | 0.0516 |
| C2 | 20 | 7.95 | 0.1352 | 0.0515 |

TABLE 5

| OLED device | Current density (mA/cm$^2$) | Drive mode | Duty cycle | Initial luminance (candela/m$^2$) | lifetime t97 (hour) | lifetime t95 (hour) |
|---|---|---|---|---|---|---|
| A2 | 15 | DC drive mode | 100% | 1217 | 495 | 950 |
| B2 | 20 | Auxiliary drive mode | 75% | 1221 | 508 | 903 |
| C2 | 20 within (0 hour, 500 hours], 15 within (500 hours, ∞ hours) | Use the auxiliary drive mode within (0 hour, 500 hours]; Use the pulse drive mode within (500 hours, ∞ hours) | 75% | 1193 | 566 | 1139 |

As shown in Table 5, for the OLED device A2, the DC drive mode may be used to drive the OLED device A2. Since the driver is configured to continuously apply a forward current to the OLED device A2 in the DC drive mode, the duty cycle of the forward current is 100%. It can be concluded from the test that, the luminescence duration that luminance of the light that is emitted by the OLED device A2 attenuates to 97% of the initial luminance is 495 hours, and the luminescence duration that luminance of the light that is emitted by the OLED device A2 attenuates to 95% of the initial luminance is 950 hours.

For the OLED device B2, it may be driven by the auxiliary drive mode in which the duty cycle of the forward current is 75%. It can be concluded from the test that, the luminescence duration that luminance of the light that is emitted by the OLED device B2 attenuates to 97% of the initial luminance is 508 hours, and the luminescence duration that luminance of the light that is emitted by the OLED device B2 attenuates to 95% of the initial luminance is 903 hours.

For the OLED device C2, it may be driven by the auxiliary drive mode in which the duty cycle of the forward current is 75% when the luminescence duration is within (0 hour, 500 hours], and may be driven by the pulse drive mode in which the duty cycle of the forward current is 75% when the luminescence duration is within (500 hours, ∞hours). It can be concluded from the test that, the luminescence duration that luminance of the light that is emitted by the OLED device C2 attenuates to 97% of the initial luminance is 566 hours, and the luminescence duration that luminance of the light that is emitted by the OLED device C2 attenuates to 95% of the initial luminance is 1139 hours.

Table 5 and FIG. 8 show that, in Table 5, the lifetime t97 of the OLED device C2 is longer than the lifetime t97 of the OLED device A2 (promote about 14.3%) and is longer than the lifetime t97 of the OLED device B2 (promote about 11%), the lifetime t95 of the OLED device C2 is longer than the lifetime t95 of the OLED device A2 (promote about 19.9%), and is longer than the lifetime t95 of the OLED device B2 is (promote about 26%). Therefore, it can be concluded that, the drive mode used by the OLED device C2 (that is, Use the auxiliary drive mode within (0 hour, 500 hours], and use the pulse drive mode within (500 hours, Go hours)) can make the OLED device C2 has a longer lifetime.

For example, in order to verify the effect of each drive mode on the lifetime of the electroluminescent device, a plurality of OLED devices (an electroluminescent device) that can emit green light may be made, which are respectively an OLED device A3, an OLED device B3, an OLED device C3, and an OLED device D3. Each of the four OLED devices may be controlled independently, and the structure, material, production method, and production time of the four OLED devices are the same, and there is no inter-chip difference.

Figure 9:
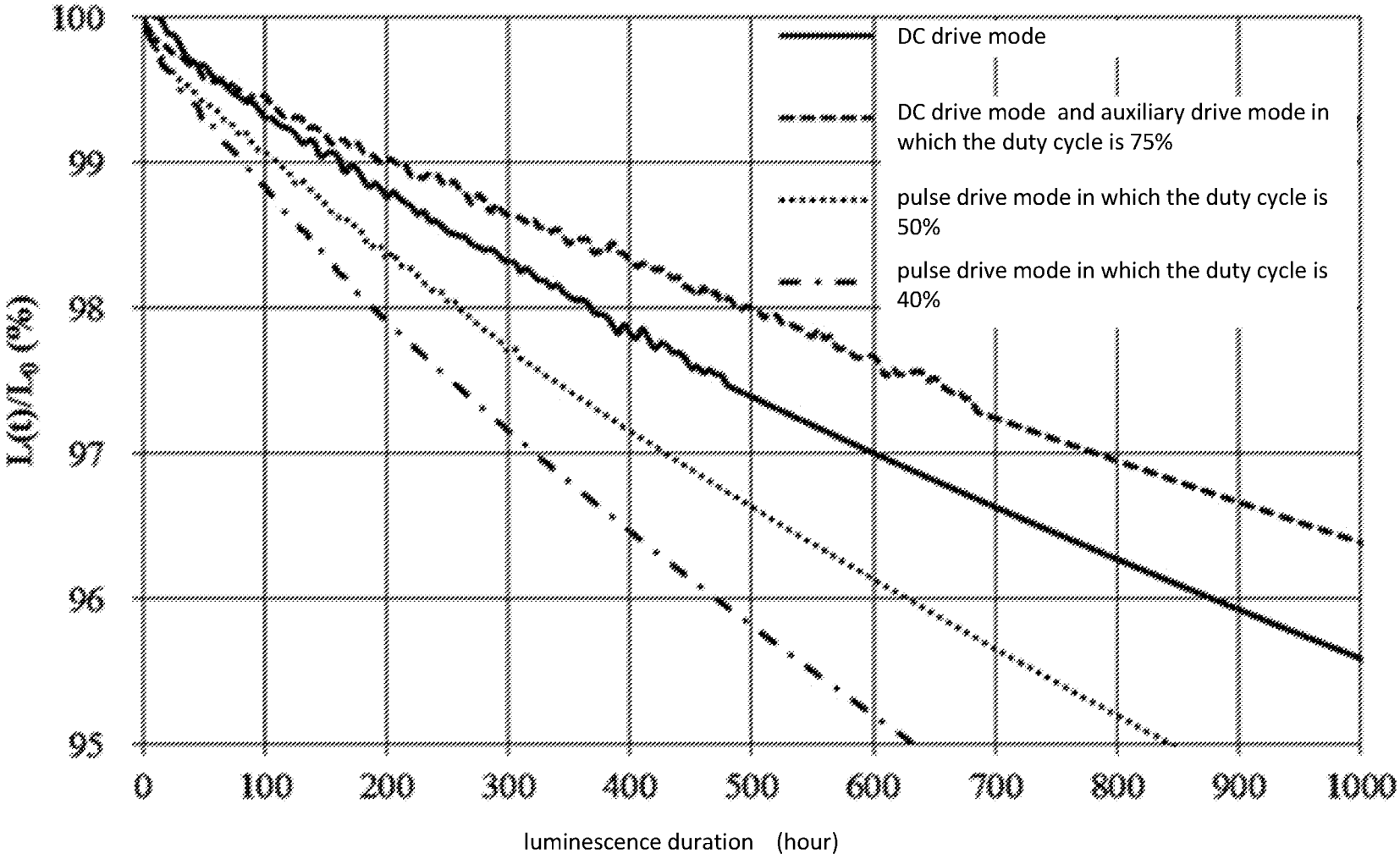
FIG. 9 schematically shows another life attenuation curve, according to an embodiment.

The color coordinates of the three OLED devices at a certain current density and a certain electric current efficiency may be shown in Table 6. After performing the lifetime tests on each of the four OLED devices separately, the lifetime tests results can be obtained as shown in Table 7, and the lifetime attenuation curves as shown in FIG. 9. It should be illustrated that, in Table 7, the lifetime t97 refers to the luminescence duration that luminance of the light that is emitted by the OLED device attenuates to 97% of the initial luminance. In Table 7, the lifetime t95 refers to the luminescence duration that luminance of the light that is emitted by the OLED device attenuates to 95% of the initial luminance.

TABLE 6

| OLED device | Current density (mA/cm$^2$) | Current efficiency (candela/A) | CIEx | CIEy |
|---|---|---|---|---|
| A3 | 15 | 133.8 | 0.2518 | 0.7176 |
| A3 | 20 | 130.9 | 0.2518 | 0.7176 |
| A3 | 30 | 128.1 | 0.2518 | 0.7176 |
| B3 | 15 | 134.6 | 0.2521 | 0.7170 |
| B3 | 20 | 131.2 | 0.2521 | 0.7170 |
| B3 | 30 | 128.5 | 0.2521 | 0.7170 |
| C3 | 15 | 133.6 | 0.2519 | 0.7175 |
| C3 | 20 | 130.5 | 0.2519 | 0.7175 |
| C3 | 30 | 127.8 | 0.2519 | 0.7175 |
| D3 | 15 | 136.2 | 0.2533 | 0.7168 |
| D3 | 20 | 132.3 | 0.2533 | 0.7168 |
| D3 | 30 | 129.1 | 0.2533 | 0.7168 |

TABLE 7

| OLED device | Current density (mA/cm$^2$) | Drive mode | Duty cycle | Initial luminance (candela/m$^2$) | lifetime t97 (hour) | lifetime t95 (hour) |
|---|---|---|---|---|---|---|
| A3 | 15 | DC drive mode | 100% | 20070 | 601 | 1183 |
| B3 | be 20.3 within (0 hour, 300 hours], | use the auxiliary drive mode within (0 hour, 300 | 75% | 19975 | 784 | 1542 |

TABLE 7-continued

| OLED device | Current density (mA/cm$^2$) | Drive mode | Duty cycle | Initial luminance (candela/m$^2$) | lifetime t97 (hour) | lifetime t95 (hour) |
|---|---|---|---|---|---|---|
| | be 15 within (300 hours, ∞ hours) | hours], and use the DC drive mode within (300 hours, ∞ hours) | | | | |
| C3 | 31.3 | auxiliary drive mode | 50% | 20000 | 429 | 845 |
| D3 | 39 | auxiliary drive mode | 40% | 19968 | 322 | 634 |

As shown in Table 7, for the OLED device A3, the DC drive mode may be used to drive the OLED device A3. Since the driver is configured to continuously apply a forward current to the OLED device A3 in the DC drive mode, the duty cycle of the forward current is 100%. It can be concluded from the test that, the luminescence duration that luminance of the light that is emitted by the OLED device A3 attenuates to 97% of the initial luminance is 601 hours, and the luminescence duration that luminance of the light that is emitted by the OLED device A3 attenuates to 95% of the initial luminance is 1183 hours.

For the OLED device B3, it may be driven by the auxiliary drive mode in which the duty cycle of the forward current is 75% when the luminescence duration is within (0 hour, 300 hours], and may be driven by the DC drive mode in which the duty cycle of the forward current is 75% when the luminescence duration is within (300 hours, ∞hours). It can be concluded from the test that, the luminescence duration that luminance of the light that is emitted by the OLED device B3 attenuates to 97% of the initial luminance is 784 hours, and the luminescence duration that luminance of the light that is emitted by the OLED device B3 attenuates to 95% of the initial luminance is 1542 hours.

For the OLED device C3, it may be driven by the auxiliary drive mode in which the duty cycle of the forward current is 50%. It can be concluded from the test that, the luminescence duration that luminance of the light that is emitted by the OLED device C3 attenuates to 97% of the initial luminance is 429 hours, and the luminescence duration that luminance of the light that is emitted by the OLED device C3 attenuates to 95% of the initial luminance is 845 hours.

For the OLED device D3, it may be driven by the auxiliary drive mode in which the duty cycle of the forward current is 40%. It can be concluded from the test that, the luminescence duration that luminance of the light that is emitted by the OLED device D3 attenuates to 97% of the initial luminance is 322 hours, and the luminescence duration that luminance of the light that is emitted by the OLED device D3 attenuates to 95% of the initial luminance is 634 hours.

Table 7 and FIG. 9 show that, in Table 7, the lifetime t97 of the OLED device B3 is longer than the lifetime t97 of the OLED device A3 (promote about 30%), and is longer than the lifetime t97 of the OLED device C3 (promote about 45%), and is longer than the lifetime t97 of the OLED device D3 (promote about 140%); the lifetime t95 of the OLED device B3 is longer than the lifetime t95 of the OLED device A3 (promote about 30%), and is longer than the lifetime t95 of the OLED device C3 is (promote about 82%), and is longer than the lifetime t95 of the OLED device D3 is (promote about 143%). Therefore, it can be concluded that, the drive mode used by the OLED device B3 (that is, Use the auxiliary drive mode within (0 hour, 300 hours], and use the DC drive mode within (300 hours, Go hours)) can make the OLED device B3 has a longer lifetime.

For example, in order to verify the effect of each drive mode on the lifetime of the electroluminescent device, a plurality of OLED devices (an electroluminescent device) that can emit red light may be made, which are respectively an OLED device A4, and an OLED device B4. Each of the two OLED devices may be controlled independently, and the structure, material, production method, and production time of the two OLED devices are the same, namely, the two OLED devices have the same characteristics, and there is no inter-chip difference.

Figure 10:
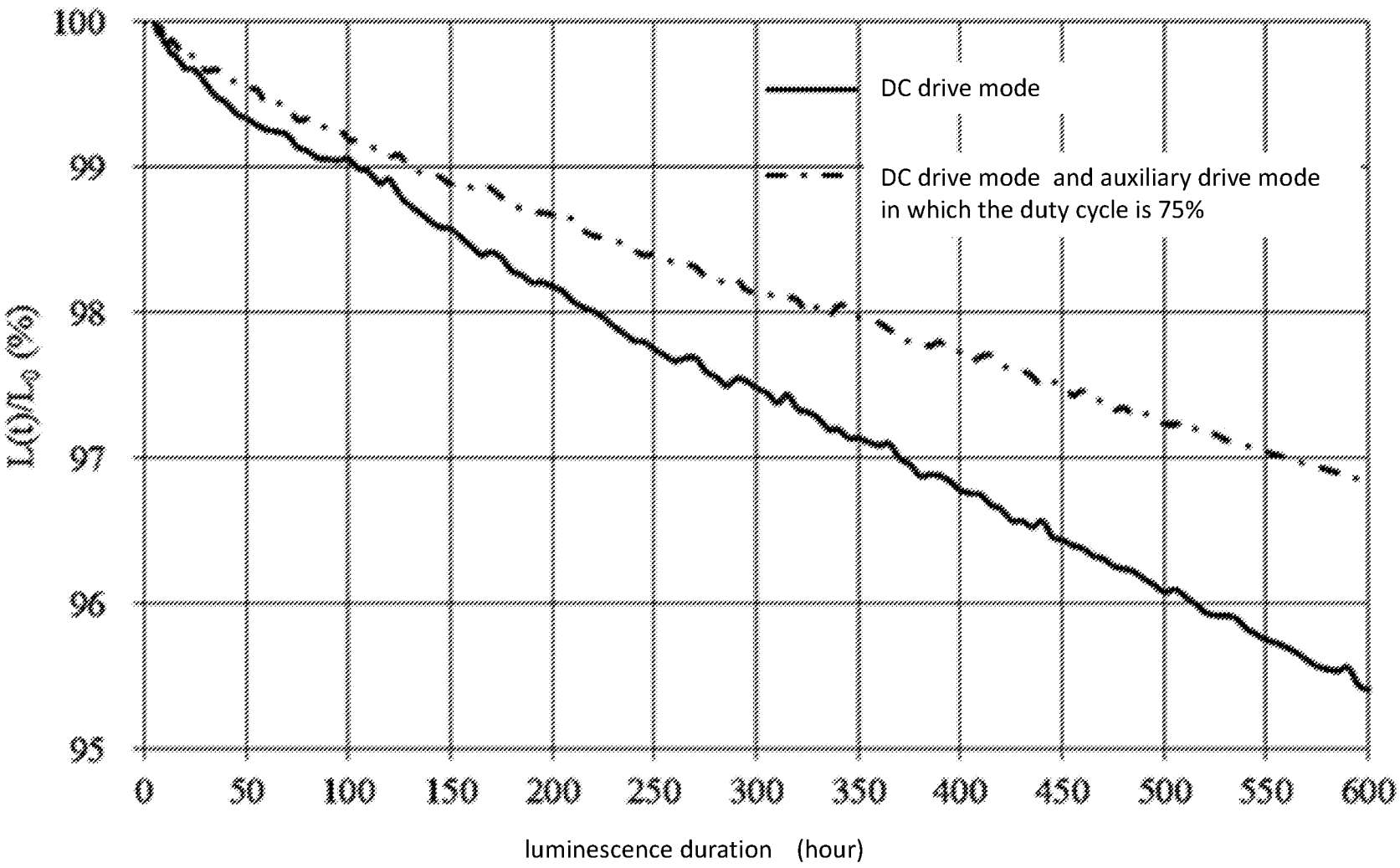
FIG. 10 schematically shows another life attenuation curve, according to an embodiment.

The color coordinates of the three OLED devices at a certain current density and a certain electric current efficiency may be shown in Table 8. After performing the lifetime tests on each of the four OLED devices separately, the lifetime tests results can be obtained as shown in Table 9, and the lifetime attenuation curves as shown in FIG. 10. It should be illustrated that, in Table 9, the lifetime t97 refers to the luminescence duration that luminance of the light that is emitted by the OLED device attenuates to 97% of the initial luminance. In Table 9, the lifetime t95 refers to the luminescence duration that luminance of the light that is emitted by the OLED device attenuates to 95% of the initial luminance.

TABLE 8

| OLED device | Current density (mA/cm$^2$) | Current efficiency (candela/A) | CIEx | CIEy |
|---|---|---|---|---|
| A4 | 15 | 48 | 0.6793 | 0.3205 |
| A4 | 20 | 46.6 | 0.6793 | 0.3205 |
| A4 | 25 | 44.1 | 0.6793 | 0.3205 |
| B4 | 15 | 47.7 | 0.6801 | 0.3197 |
| B4 | 20 | 46.2 | 0.6801 | 0.3197 |
| B4 | 25 | 43.9 | 0.6801 | 0.3197 |

TABLE 9

| OLED device | Current density (mA/cm$^2$) | Drive mode | Duty cycle | Initial luminance (candela/m$^2$) | lifetime t97 (hour) | lifetime t95 (hour) |
|---|---|---|---|---|---|---|
| A4 | 20 | DC drive mode | 100% | 9320 | 369 | 666 |
| B4 | Be 28.3 within (0 hour, 500 | Use the auxiliary drive mode within | 75% | 9318 | 561 | 1094 |

TABLE 9-continued

| OLED device | Current density (mA/cm$^2$) | Drive mode | Duty cycle | Initial luminance (candela/m$^2$) | lifetime t97 (hour) | lifetime t95 (hour) |
|---|---|---|---|---|---|---|
| | hours], and be 20 within (500 hours, ∞ hours) | (0 hour, 500 hours], use the DC drive mode within (500 hours, ∞ hours) | | | | |

As shown in Table 9, for the OLED device A4, the DC drive mode may be used to drive the OLED device A4. Since the driver is configured to continuously apply a forward current to the OLED device A4 in the DC drive mode, the duty cycle of the forward current is 100%. It can be concluded from the test that, the luminescence duration that luminance of the light that is emitted by the OLED device A4 attenuates to 97% of the initial luminance is 369 hours, and the luminescence duration that luminance of the light that is emitted by the OLED device A4 attenuates to 95% of the initial luminance is 666 hours.

For the OLED device B4, it may be driven by the auxiliary drive mode in which the duty cycle of the forward current is 75% when the luminescence duration is within (0 hour, 500 hours], and may be driven by the DC drive mode in which the duty cycle of the forward current is 75% when the luminescence duration is within (500 hours, ∞hours). It can be concluded from the test that, the luminescence duration that luminance of the light that is emitted by the OLED device B4 attenuates to 97% of the initial luminance is 561 hours, and the luminescence duration that luminance of the light that is emitted by the OLED device B4 attenuates to 95% of the initial luminance is 1094 hours.

Table 9 and FIG. 10 show that, the lifetime t97 of the OLED device B4 is longer than the lifetime t97 of the OLED device A4 (promote about 52%), and the lifetime t95 of the OLED device B4 is longer than the lifetime t95 of the OLED device A4 (promote about 64%). Therefore, it can be concluded that, the drive mode used by the OLED device B4 (that is, Use the auxiliary drive mode within (0 hour, 500 hours], and use the DC drive mode within (500 hours, co hours)) can make the OLED device B4 has a longer lifetime.

Figure 11:
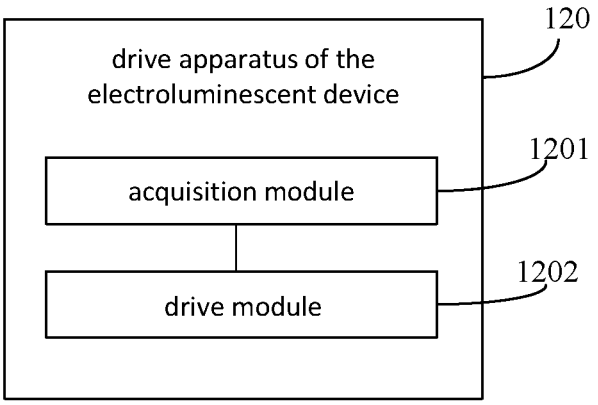
FIG. 11 schematically shows a structural diagram of a drive apparatus of the electroluminescent device, according to an embodiment.

FIG. 11 schematically shows a structural diagram of a drive apparatus of the electroluminescent device, according to an embodiment, the driver of the electroluminescent device shown in FIG. 1 may comprise drive apparatus of the electroluminescent device. As shown in FIG. 11, the drive apparatus of the electroluminescent device 120 may comprise:

An acquisition module 1201 is configured to acquire a drive mode sequence by permuting and combining at least two drive modes used to drive the electroluminescent device.

A drive module 1202 is configured to sequentially use the drive modes of the drive mode sequence to drive the electroluminescent device.

The acquisition module may acquire the drive mode sequence by permuting and combining at least two drive modes used to drive the electroluminescent device. The drive module may drive the electroluminescent device by using the mixed plurality of drive modes of the drive mode sequence. In this way, the driver may use a mixed plurality of drive modes to drive the electroluminescent device, thereby enriching the drive modes of the electroluminescent device.

Optionally, the drive modes in the drive mode sequence comprise at least two drive modes of a DC drive mode, a pulse drive mode, and an auxiliary drive mode; wherein, in the DC drive mode, the drive module is configured to continuously apply a forward current to the electroluminescent device; in the pulse drive mode, the driver is configured to periodically apply a forward current to the electroluminescent device, and stop applying the electric current to the electroluminescent device during the interval period between any two adjacent application periods of the forward current; in the auxiliary drive mode, the driver is configured to periodically apply a forward current to the electroluminescent device, and apply a reverse current during the interval period between any two adjacent application periods of the forward current, wherein the absolute value of the reverse current is less than the absolute value of the forward current.

Optionally, the drive modes in the drive mode sequence comprise: a first drive mode and a second drive mode, the first drive mode is a pulse drive mode, and the second drive mode is a DC drive mode; or the first drive mode is a pulse drive mode, and the second drive mode is an auxiliary drive mode; or the first drive mode is an auxiliary drive mode, and the second drive mode is a DC drive mode.

Optionally, the drive mode sequence is formed by alternately arranging by the first drive mode and the second drive mode, and the first drive mode of the drive mode sequence is a pulse drive mode or an auxiliary drive mode.

Figure 12:
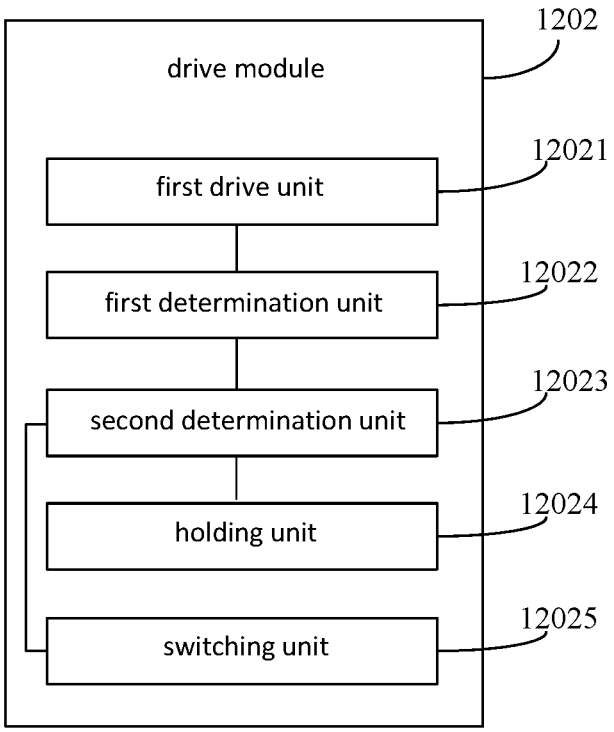
FIG. 12 schematically shows a structural diagram of a drive module, according to an embodiment.

Optionally, FIG. 12 schematically shows a structural diagram of a drive module, according to an embodiment. As shown in FIG. 12, the drive module 1202 may comprise:

A first drive unit 12021 is configured to drive the electroluminescent device by using the first drive mode of the drive mode sequence;

A first determination unit 12022 is configured to determine the effective light emission duration of the electroluminescent device at each of a plurality of the luminescence moment. Wherein the amount of luminance attenuation of the electroluminescent device at a certain luminescence moment is equivalent to: at the target ambient temperature, the amount of luminance attenuation of the electroluminescent device when the duration of the light of the target luminance that is emitted by the electroluminescent device reaches the effective light emission duration at each of the luminescence moment.

A second determination unit 12023 is configured to determine the drive mode corresponding to the duration range where the effective light emission duration is in at each of the luminescence moment as the drive mode corresponding to each of the luminescence moment, according to the one-to-one correspondence between the plurality of duration ranges and the plurality of drive modes of the drive mode sequence, and in the correspondence, the duration in the duration range corresponding to the drive mode is positively correlated with the order of the drive mode of the drive mode sequence.

A holding unit 12024 is configured to keep the used drive mode unchanged, when the drive mode corresponding to the i-th of the luminescence moment is same with the drive mode used at the i-th of the luminescence moment, i≥1.

A switching unit 12025 is configured to switch the drive mode currently used to the drive mode corresponding to the i-th of the luminescence moment, when the drive mode corresponding to the i-th of the luminescence moment is different with the drive mode used at the i-th of the luminescence moment.

Figure 13:
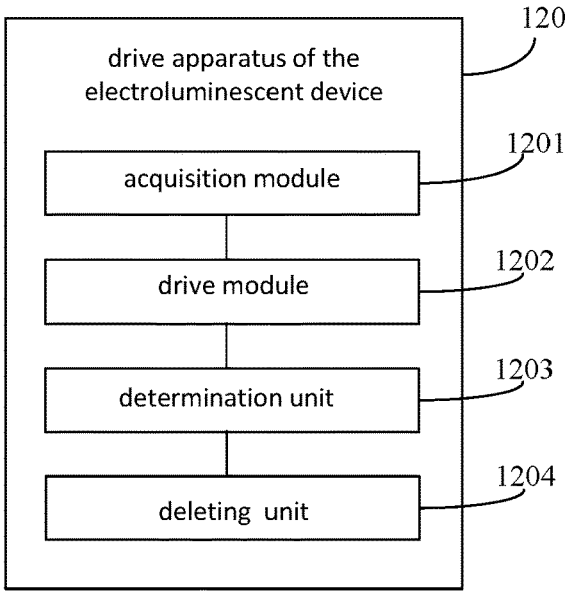
FIG. 13 schematically shows a structural diagram of another drive apparatus of the electroluminescent device, according to an embodiment.

Optionally, FIG. 13 schematically shows another structural diagram of a drive apparatus of the electroluminescent device, according to an embodiment. As shown in FIG. 13, based on FIG. 11 and FIG. 12, the drive apparatus of the electroluminescent device 120 may further comprise:

A determining module 1203 is configured to determine the basic duration corresponding to each illuminating sub-process, according to the collected luminescence parameter set; wherein the amount of luminance attenuation of the electroluminescent device in each illuminating sub-process is equivalent to: at the target ambient temperature, the amount of luminance attenuation of the electroluminescent device when the luminescence duration of the light of the target luminance that is emitted by the electroluminescent device reaches the basic duration corresponding to each of the luminescence moment; the illuminating process of the electroluminescent device comprises at least one illuminating sub-process.

A first determination unit 12022 is configured to determine the sum of all determined basic durations as the effective light emission duration of the electroluminescent device at each of the luminescence moment.

Optionally, the determination module 1203 is configured to:

Count at least one of the luminescence parameters sets in each luminescence sub-process during the luminescence process of the electroluminescent device, wherein the luminescence parameter set may comprise: an ambient temperature and a luminance, and luminescence duration that the electroluminescent device emits light of the luminance at the ambient temperature. And, at least one of the ambient temperatures and luminance in different luminescence parameter sets is different;

Determine the duration corresponding to each luminescence parameter set counted during the luminescence sub-process, wherein, the amount of the luminance attenuation of the electroluminescent device under the parameter of the luminescence parameter set is equivalent to: at the target ambient temperature, the amount of luminance attenuation of the electroluminescent device when the luminescence duration of the light of the target luminance that is emitted by the electroluminescent device reaches the luminescence duration corresponding to each of the luminescence moment;

Determine the sum of the durations corresponding to all luminescence parameter sets counted in each luminescence sub-process as a basic duration corresponding to each luminescence sub-process.

Optionally, referring to FIG. 13, the drive module may further comprise:

Deleting unit 1204 is configured to delete the luminescence parameter set of the electroluminescent device in each luminescence sub-process, after determining the basic duration corresponding to each luminescence sub-process.

Optionally, in the pulse drive mode or the auxiliary drive mode, the driver is configured to apply a forward current with a frequency in a range from 30 Hz to 360 Hz to the electroluminescent device.

Optionally, in the pulse drive mode or the auxiliary drive mode, the driver is configured to apply a forward current with a duty cycle in a range from 30% to 99% to the electroluminescent device.

Optionally, the electric voltage corresponding to the reverse current may be in a range from −0.01 V to −10 V.

The acquisition module may acquire the drive mode sequence by permuting and combining at least two drive modes used to drive the electroluminescent device. The drive module may drive the electroluminescent device by using the mixed plurality of drive modes of the drive mode sequence. In this way, the driver may use a mixed plurality of drive modes to drive the electroluminescent device, thereby enriching the drive modes of the electroluminescent device.

Figure 14:
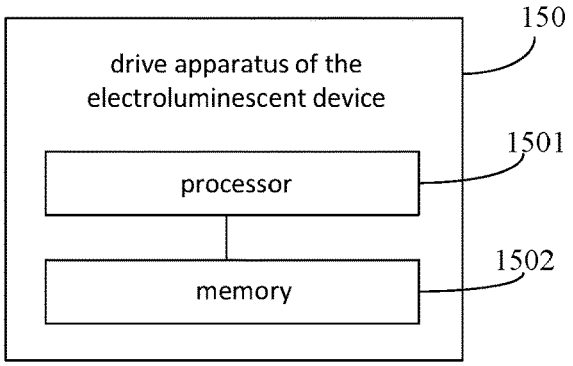
FIG. 14 schematically shows a structural diagram of another drive apparatus of the electroluminescent device, according to an embodiment.

FIG. 14 schematically shows one more structural diagram of a drive apparatus of the electroluminescent device, according to an embodiment, the driver shown in FIG. 1 may comprise drive apparatus of the electroluminescent device shown in FIG. 4. As shown in FIG. 14, the drive apparatus of the electroluminescent device 150 may further comprise:

A processor 1501;

A memory 1502 used to store the executable instructions of the processor;

Wherein, the processor 1501 may execute the drive method of the electroluminescent device when the processor 1501 executes the executable instructions.

The drive apparatus of the electroluminescent device may acquire the drive mode sequence by permuting and combining at least two drive modes used to drive the electroluminescent device, and may drive the electroluminescent device by using the mixed plurality of drive modes of the drive mode sequence. In this way, the driver may use a mixed plurality of drive modes to drive the electroluminescent device, thereby enriching the drive modes of the electroluminescent device.

Figure 15:
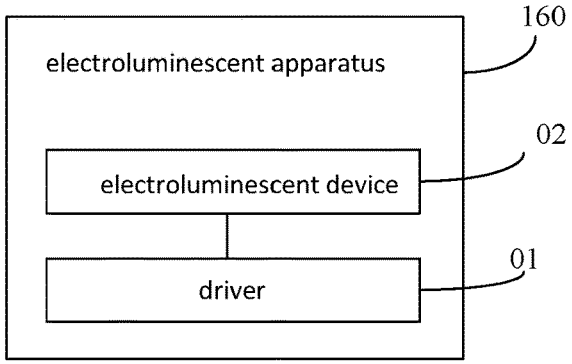
FIG. 15 schematically shows a structural diagram of an electroluminescent apparatus, according to an embodiment.

FIG. 15 schematically shows a structural diagram of an electroluminescent apparatus, according to an embodiment, as shown in FIG. 15, the electroluminescent apparatus 160 may comprise: the electroluminescent device 120, and the driver 01 of the electroluminescent device 120, the electroluminescent device 120 is electrically connected to the driver 01, the driver 01 comprises the drive apparatus of the electroluminescent device (e.g., the electroluminescent device 120 as shown in FIG. 11, FIG. 13, or FIG. 14).

Optionally, the electroluminescent apparatus 160 may be an organic light-emitting diode display device, the electroluminescent device 02 is an organic light-emitting diode device in the organic light-emitting diode display device, and the driver 01 is a timing controller. Optionally, the driver 01 may also be other devices, such as a microcontroller unit (MCU).

Figure 16:
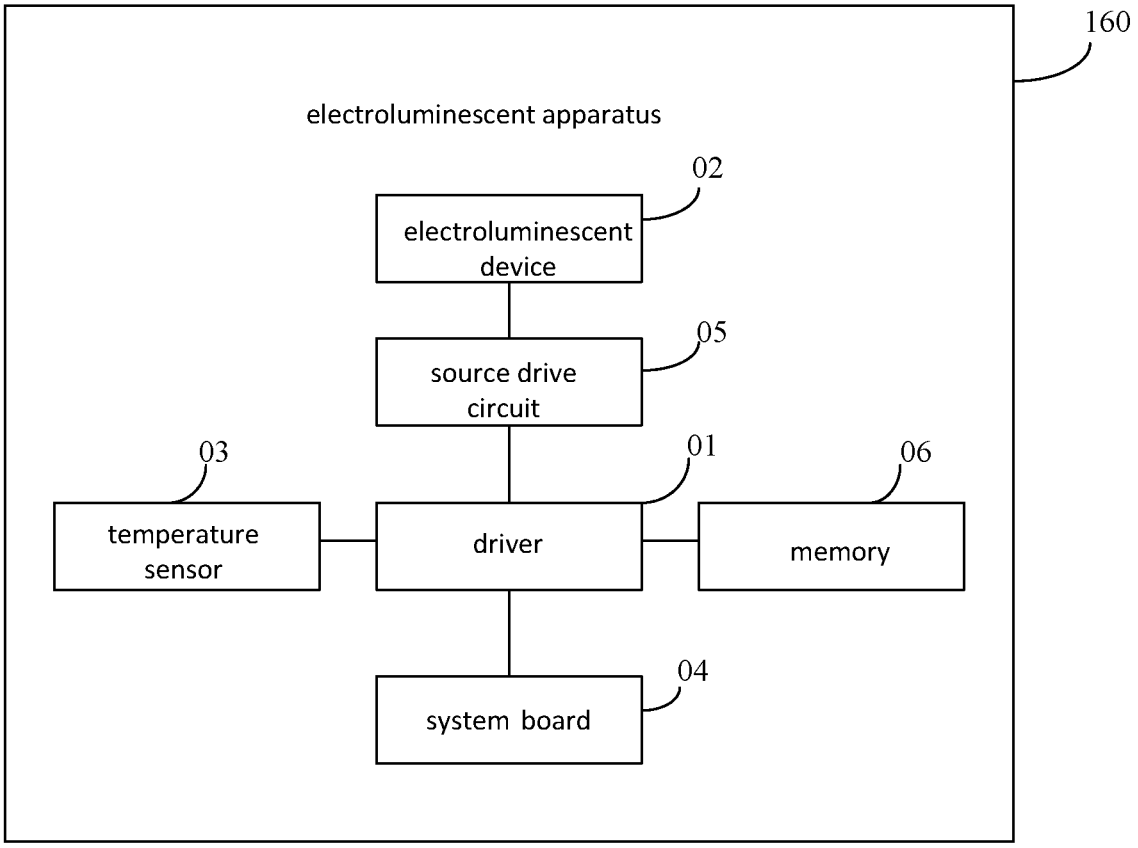
FIG. 16 schematically shows a structural diagram of another electroluminescent device, according to an embodiment.

Optionally, FIG. 16 schematically shows a structural diagram of another electroluminescent device, according to an embodiment, as shown in FIG. 16, and based on FIG. 15, the electroluminescent apparatus may comprise the temperature sensor 03, the system board 04, and the source drive circuit 05.

The driver 01 of the electroluminescent device may be connected to a temperature sensor 03, and the temperature of the ambient light when the electroluminescent device 02 emits light may be detected by the temperature sensor 03. In addition, the driver 01 of the electroluminescent device may also be connected to a system board 04, and connected to the electroluminescent device 02 via a source drive circuit 05. The system board 04 is configured to transmit indication information of the luminance of the light that the electroluminescent device 02 should emit to the driver 01, so that the driver 01 may drive the electroluminescent device 02 through the source drive circuit 05 in accordance based on the indication information. At that time, the driver 01 may determine the luminance of the light emitted from the electroluminescent device 02 based on the indication information transmitted by the system board 04.

Optionally, the electroluminescent apparatus may comprise the memory 06. The driver 01 may also be connected to the memory 06. The driver 01 may store the basic duration through the memory 06, after determining the basic duration corresponding to one luminescence sub-process every time. Optionally, the driver 01, the memory 06, and the temperature sensor 03 may be arranged on the same substrate.

In an optional implementation manner, the OLED display apparatus may be a product with display function. For example, it can be any product with display function such as electronic paper, mobile phone, tablet computer, television, notebook computer, digital photo frame, navigator etc.

In addition, there is the solution for extending the lifetime of the OLED device in an OLED display apparatus in the related technologies, wherein, two OLED devices are set in each pixel in the OLED display apparatus, and the two OLED devices respectively operate at different periods, so that reduces the luminescence duration of each OLED device to increase the lifetime of each OLED device. However, in this solution, there are two OLED devices in each pixel of the OLED display apparatus, resulting in a larger area per pixel and a lower resolution of the entire OLED display apparatus.

A non-transitory computer readable storage medium may be provided, and the instructions are storage on the readable storage medium, and when the readable storage medium is run on a processor, cause the processor to perform the drive method of the electroluminescent device.

A chip may be provided, where the chip comprises a programmable logic circuit and/or program instructions, and when the chip operates, it is used to implement the driving method of the electroluminescent device.

A computer program product may be provided, wherein the computer program product stores instructions, and when the computer program product is run on a computer, causes the computer to execute the method of the electroluminescent device described herein.

A method for driving an LED, according to an embodiment, may include determining a first waveform of electric voltage based on a history of operation of a light-emitting diode (LED), the history of operation comprising one or more parameters selected from the group consisting of durations of light emission of the LED, intensities of light emission of the LED, temperatures of the LED during light emission, and combinations thereof; and applying the first waveform of electric voltage to the LED.

The method may further include updating the history of operation with information of operation of the LED; determining a second waveform of electric voltage based on the updated history of operation of LED; applying the second waveform of electric voltage to the LED. The information of operation of the LED may include a temperature of the LED. The LED may be an organic light-emitting diode (OLED). The LED may be a pixel of a display panel.

Determining the first waveform may include computing an effective light emission duration based on the history of operation. Determining the first waveform may include determining a parameter of the first waveform, the parameter being selected from the group consisting of a duty cycle, a frequency and a spectral density. The first waveform may be a constant voltage. The first waveform may be a pulse wave. The pulse wave may have alternating polarities. The pulse wave may have a constant polarity. The first waveform may have a frequency in a range from 30 Hz to 360 Hz. The first waveform may have a duty cycle in a range from 30% to 99%. The first waveform may have a minimum in a range from −0.01 V to −10 V.

An apparatus according to an embodiment includes: a processor; a waveform generator; a memory; wherein the memory is configured to store a history of operation of an LED, the history of operation comprising one or more parameters selected from the group consisting of durations of light emission of the LED, intensities of light emission of the LED, temperatures of the LED during light emission and combinations thereof; wherein the processor is configured to determine a first waveform of electric voltage based on the history of operation stored in the memory; wherein the waveform generator is configured to generate the first waveform of electric voltage and apply the first waveform to the LED.

The processor may be configured to update the history of operation, with information of operation of the LED, to determine a second waveform of electric voltage based on the updated history of operation of the LED, to generate the second waveform of electric voltage and apply the second waveform to the LED.

The apparatus may further include a temperature sensor; wherein the information of operation of the LED comprises a temperature of the LED measured by the temperature sensor.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method comprising:

determining a first waveform of electric voltage based on a history of operation of an electroluminescent device, the history of operation comprising one or more parameters selected from a group consisting of durations of light emission of the electroluminescent device, intensities of light emission of the electroluminescent device, temperatures of the electroluminescent device during light emission, and combinations thereof;

applying the first waveform of electric voltage to the electroluminescent device;

wherein determining the first waveform comprises computing an effective light emission duration based on the history of operation;

wherein computing the effective light emission duration comprises determining a normalized duration based on the intensity of light emission and the temperature in each of the durations of light emission and computing the effective light emission duration as a sum of the normalized durations;

wherein luminance attenuation of the electroluminescent device during that duration of light emission equals luminance attenuation of the electroluminescent device during the normalized duration in which the electroluminescent device is at a target temperature and has a target intensity of light emission.

2. The method of claim 1, wherein the first waveform is a pulse wave.

3. The method of claim 1, further comprising:

updating the history of operation with information of operation of the electroluminescent device;

determining a second waveform of electric voltage based on the updated history of operation;

applying the second waveform of electric voltage to the electroluminescent device.

4. The method of claim 3, wherein the second waveform is different from the first waveform.

5. The method of claim 3, wherein the second waveform is a constant voltage.

6. The method of claim 1, wherein determining the first waveform comprises selecting the first waveform from a plurality of waveforms based on the effective light emission duration.

7. The method of claim 1, wherein determining the first waveform comprises determining a parameter of the first waveform, the parameter being selected from the group consisting of a duty cycle, a frequency and a spectral density.

8. A computer program product comprising a non-transitory computer readable medium having instructions recorded thereon, the instructions when executed by a computer implementing a method of claim 1.

9. A method comprising:

obtaining a drive mode sequence comprising a sequential arrangement of at least two drive modes for driving an electroluminescent device to emit light;

driving the electroluminescent device by sequentially applying the drive modes in the drive mode sequence;

wherein obtaining the drive mode sequence further comprises, for each of the drive modes in the drive mode sequence, determining an effective light emission duration of the electroluminescent device and determining that each of the drive modes based on the effective light emission duration;

wherein determining the effective light emission duration comprises determining a normalized duration based on the intensity of light emission and the temperature in each of the time periods before that each of the drive modes and computing the effective light emission duration as a sum of the normalized durations;

wherein luminance attenuation of the electroluminescent device during that time period equals luminance attenuation of the electroluminescent device during the normalized duration in which the electroluminescent device is at a target temperature and has a target intensity of light emission.

10. The method of claim 9, wherein the at least two drive modes are selected from a group consisting of a direct current (DC) drive mode, a pulse drive mode, and an auxiliary drive mode;

wherein, in the DC drive mode, a forward current is continuously applied to the electroluminescent device;

wherein, in the pulse drive mode, pulses of a forward current are applied to the electroluminescent device and no current is applied to the electroluminescent device between adjacent pairs of the pulses;

wherein, in the auxiliary drive mode, pulses of a forward current are applied to the electroluminescent device and a reverse current is applied to the electroluminescent device between adjacent pairs of the pulses, the reverse current having an absolute value smaller than an absolute value of the forward current.

11. The method of claim 10, wherein the at least two drive modes consist of the pulse drive and the DC drive mode; or wherein the at least two drive modes consist of the pulse drive mode and the auxiliary drive mode; or wherein the at least two drive modes consist of the auxiliary drive mode and the DC drive mode.

12. The method of claim 11, wherein the drive mode sequence begins with the pulse drive mode or the auxiliary drive mode.

13. A computer program product comprising a non-transitory computer readable medium having instructions recorded thereon, the instructions when executed by a computer implementing a method of claim 9.

14. An apparatus comprising:

a processor;

a waveform generator;

a memory;

wherein the memory is configured to store a history of operation of an electroluminescent device, the history of operation comprising one or more parameters selected from the group consisting of durations of light emission of the electroluminescent device, intensities of light emission of the electroluminescent device, temperatures of the electroluminescent device during light emission and combinations thereof;

wherein the processor is configured to determine a first waveform of electric voltage based on the history of operation stored in the memory;

wherein the waveform generator is configured to generate the first waveform of electric voltage and apply the first waveform to the electroluminescent device;

wherein the processor is configured to determine the first waveform by computing an effective light emission duration based on the history of operation;

wherein the processor is configured to compute the effective light emission duration by determining a normalized duration based on the intensity of light emission and the temperature in each of the durations of light emission and computing the effective light emission duration as a sum of the normalized durations;

wherein luminance attenuation of the electroluminescent device during that duration of light emission equals luminance attenuation of the electroluminescent device during the normalized duration in which the electroluminescent device is at a target temperature and has a target intensity of light emission.

15. The apparatus of claim 14, wherein the first waveform is a pulse wave.

16. The apparatus of claim 14, wherein the processor is configured to update the history of operation, with information of operation of the electroluminescent device;

wherein the processor is configured to determine a second waveform of electric voltage based on the updated history of operation of the electroluminescent device;

wherein the waveform generator is configured to generate the second waveform of electric voltage and apply the second waveform to the electroluminescent device.

17. The apparatus of claim 16, wherein the second waveform is different from the first waveform.

18. The apparatus of claim 16, wherein the second waveform is a constant voltage.

19. The apparatus of claim 16, further comprising a temperature sensor;

wherein the information of operation of the electroluminescent device comprises a temperature of the electroluminescent device measured by the temperature sensor.

20. The apparatus of claim 14, wherein the processor is configured to determine the first waveform by selecting the first waveform from a plurality of waveforms based on the effective light emission duration.

21. A display panel comprising the apparatus of claim 14.

* * * * *